US007635239B2

(12) United States Patent
Lawler

(10) Patent No.: US 7,635,239 B2
(45) Date of Patent: Dec. 22, 2009

(54) SUBSEA SUCTION PILE CRANE SYSTEM

(75) Inventor: Kinton Lawler, Fulshear, TX (US)

(73) Assignee: Oceaneering International, Inc., Houston, TX (US)

( * ) Notice: Subject to any disclaimer, the term of this patent is extended or adjusted under 35 U.S.C. 154(b) by 0 days.

(21) Appl. No.: 12/196,854

(22) Filed: Aug. 22, 2008

(65) Prior Publication Data

US 2009/0052994 A1 Feb. 26, 2009

Related U.S. Application Data

(60) Provisional application No. 60/957,933, filed on Aug. 24, 2007.

(51) Int. Cl.
*E02D 5/74* (2006.01)
*B63B 21/27* (2006.01)
*E02D 7/20* (2006.01)

(52) U.S. Cl. ..... 405/224.1; 405/224; 405/226; 405/228

(58) Field of Classification Search ..... 405/224.1, 405/228, 226, 224, 295.1
See application file for complete search history.

(56) References Cited

U.S. PATENT DOCUMENTS 2,771,747 A * 11/1956 Rechtin ..... 405/208
4,151,393 A * 4/1979 Fenneman et al. ..... 219/121.6
4,179,233 A 12/1979 Bromell et al.
4,892,202 A 1/1990 Hey et al.
4,943,187 A 7/1990 Hopper
5,253,606 A 10/1993 Ortelli
6,601,649 B2 8/2003 Beato et al.
6,910,831 B2 * 6/2005 Raines ..... 405/224.1
2003/0167659 A1 * 9/2003 Raines ..... 37/345
2006/0065180 A1 * 3/2006 Raines ..... 114/295
2006/0140726 A1 6/2006 Pollack et al.
2006/0201679 A1 9/2006 Williams
2007/0034379 A1 2/2007 Fenton et al.
2009/0129870 A1 * 5/2009 Jones ..... 405/228

FOREIGN PATENT DOCUMENTS

JP 10280404 A * 10/1998
JP 2001032249 * 2/2001

* cited by examiner

*Primary Examiner*—Frederick L Lagman
(74) *Attorney, Agent, or Firm*—Duane Morris LLP

(57) ABSTRACT

A subsea suction pile crane system comprises a suction pile and a crane mounted on the suction pile. The crane comprises a rotatable mounting surface, a winch, and a boom having a proximal section attached to the rotatable mounting surface such that the boom can pivot with respect to the mounting surface, and a distal section opposite the proximal section. In embodiments, a plurality of suction piles may be used. The crane system is typically hydraulically operated. A preferred embodiment of the invention may further comprise a remotely operated vehicle comprising a hydraulic power supply operatively coupled to the crane, and a manipulator arm mounted on the distal section of the boom and operatively coupled to the hydraulic power supply.

16 Claims, 12 Drawing Sheets

SUBSEA SUCTION PILE CRANE SYSTEM

RELATION TO OTHER APPLICATIONS

This application claims priority through U.S. Provisional Application 60/957,933 filed Aug. 24, 2007.

BACKGROUND OF THE INVENTION

Many subsea projects require the ability to safely and accurately lift heavy loads from the seabed. In many cases, the preferred option is to conduct this lifting on the seabed itself, rather than lifting from a surface vessel, since the seabed is stable and can support virtually unlimited loads. In many applications, the weight of the lifting appliance and its payload have to be spread across a large surface of the seabed using large, cumbersome structures known as "mud mats."

Problems exist with simply installing two piles and laying a gantry "beam" across the top, e.g. it is nearly impossible to locate a second pile an exact distance from the first installed pile; it is nearly impossible to install either pile plumb; it is nearly impossible to raise and lower both piles synchronously; and the position of the lifting interface relative to the object to be lifted is nearly impossible to locate exactly when the piles are installed.

SUMMARY OF THE INVENTION

The invention has various embodiments.

In an embodiment, a crane uses a static suction pile as its base.

In another embodiment, a gantry crane uses a plurality of static suction piles as its base.

In another embodiment, a crane uses a dynamic (moveable) suction pile both as its base and its primary mechanism for vertical movement.

In another embodiment, a gantry crane uses a plurality of dynamic (moveable) suction piles as its base and its primary mechanism for vertical movement.

Additionally, a control system is disclosed for controlling a gantry crane system which relies on a plurality of dynamic (moveable) suction piles as its base and its primary mechanism for vertical movement.

For example, in an embodiment, a subsea suction pile crane system comprises a suction pile and a crane mounted on the suction pile. In this embodiment, the crane comprises a rotatable mounting surface, a winch, and a boom having a proximal section attached to the rotatable mounting surface such that the boom can pivot with respect to the mounting surface, and a distal section opposite the proximal section. In a preferred embodiment, the crane system is hydraulically operated.

A preferred embodiment of the invention may further comprise a remotely operated vehicle comprising a hydraulic power supply operatively coupled to the crane, and a manipulator arm mounted on the distal section of the boom and operatively coupled to the hydraulic power supply.

DESCRIPTION OF THE DRAWINGS

Various embodiments of the inventions disclosed herein are illustrated in the Figures as discussed herein below.

DESCRIPTION OF PREFERRED EMBODIMENTS

Figure 1:
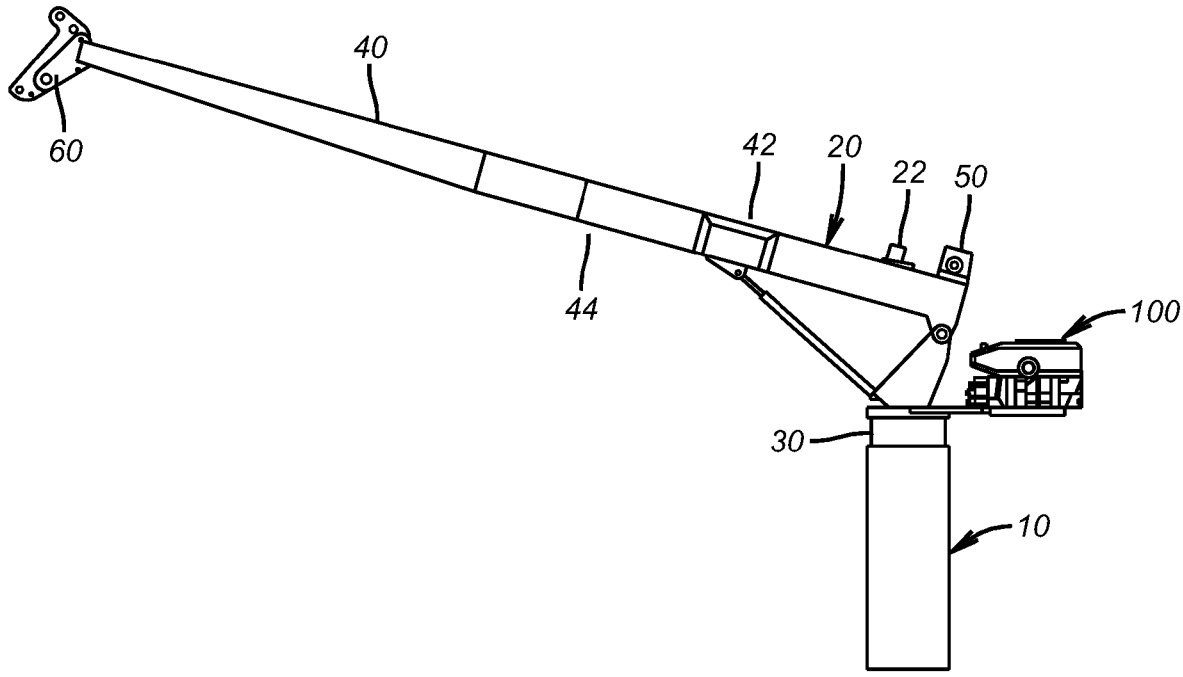
FIGS. 1-6 illustrate a first embodiment of the invention.
Figure 2:
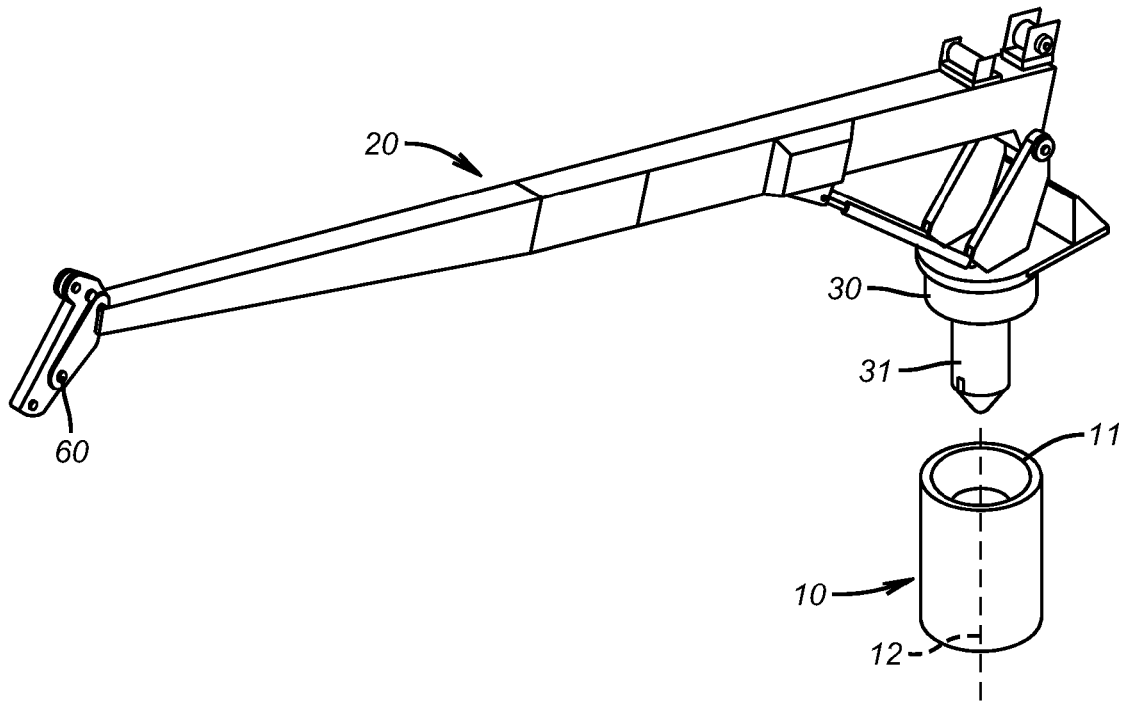
Figure 3:
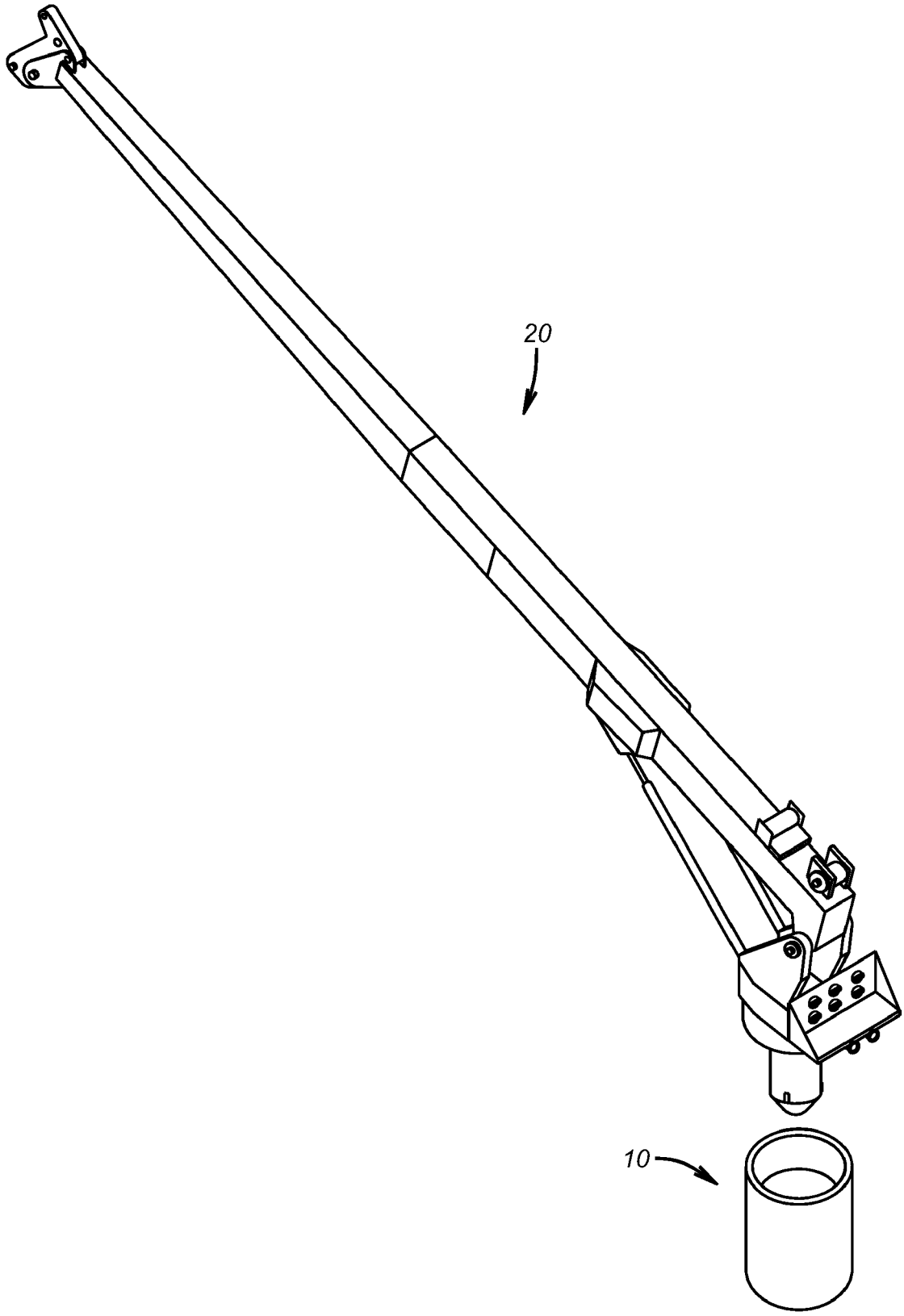
Figure 4:
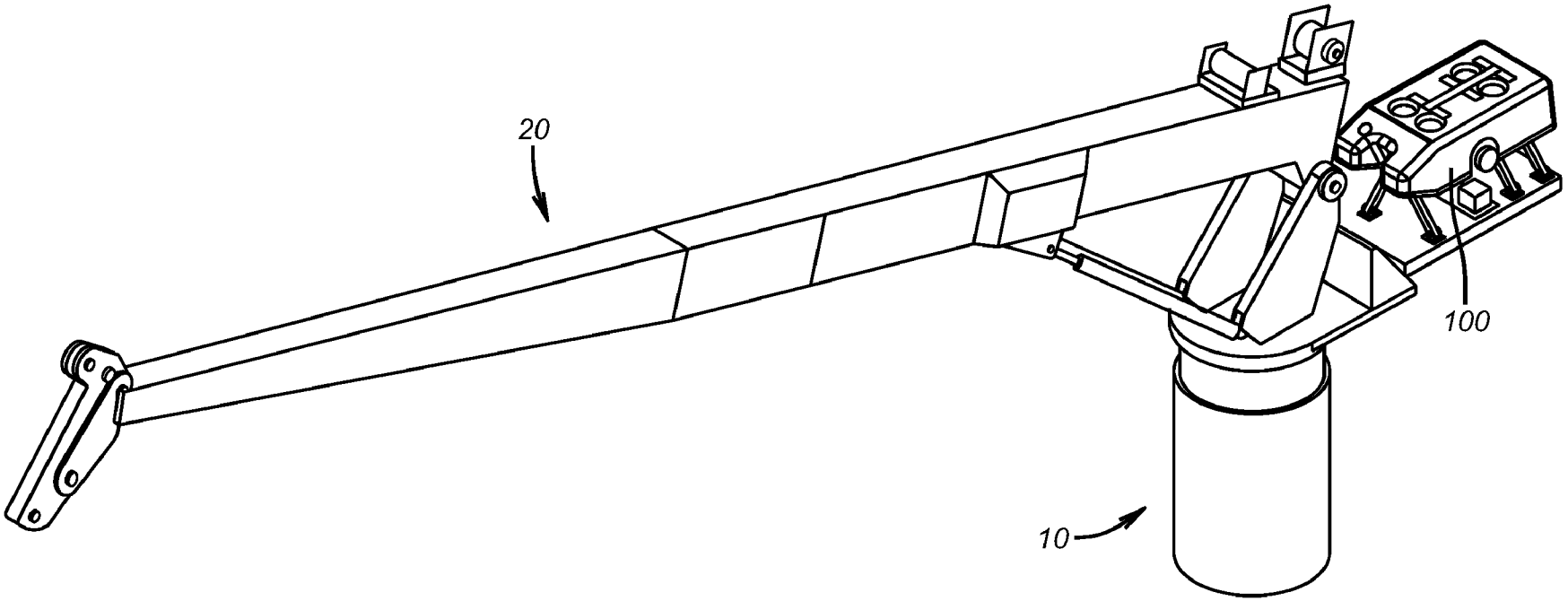
Figure 5:
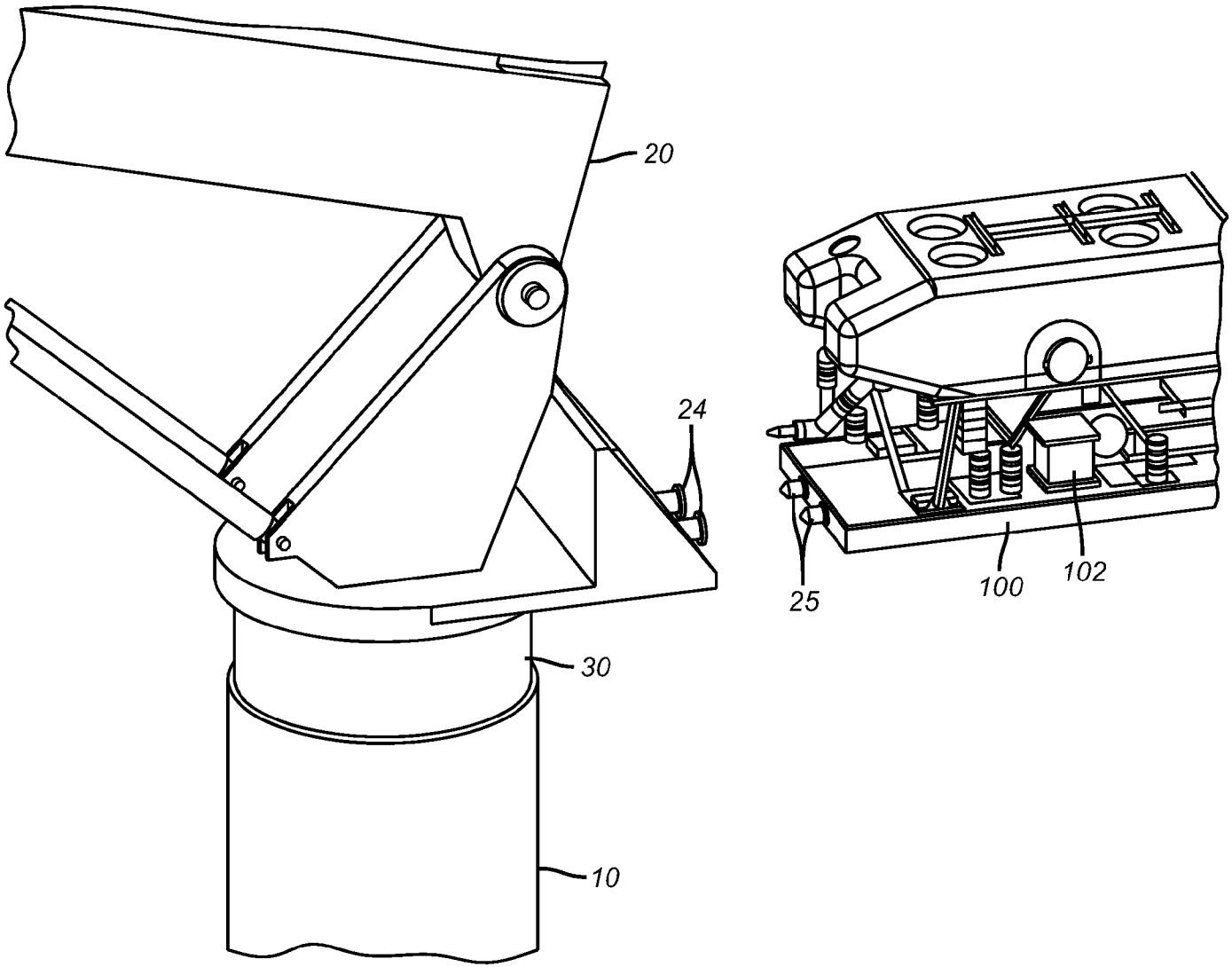
Figure 6:
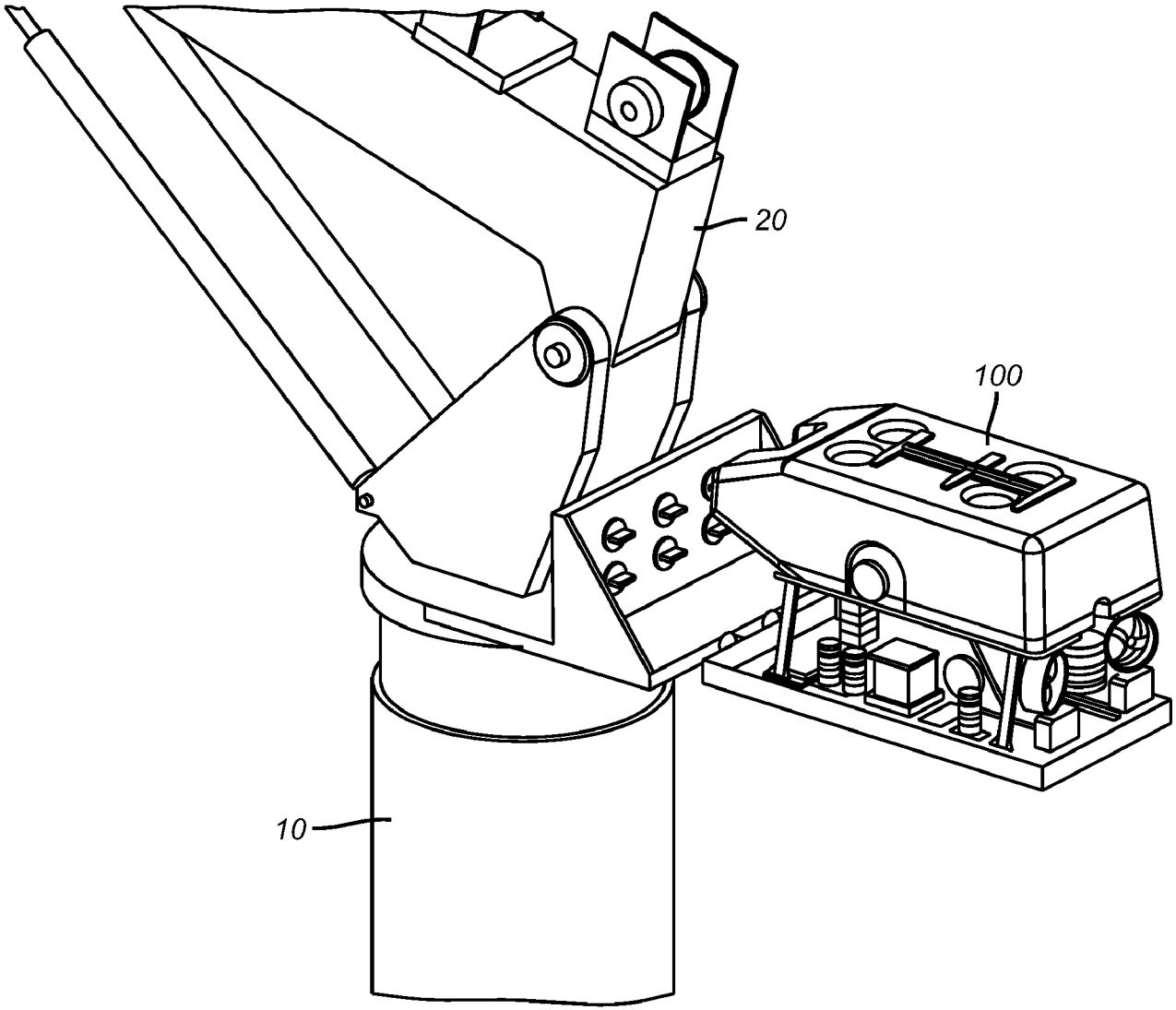
Figure 7:
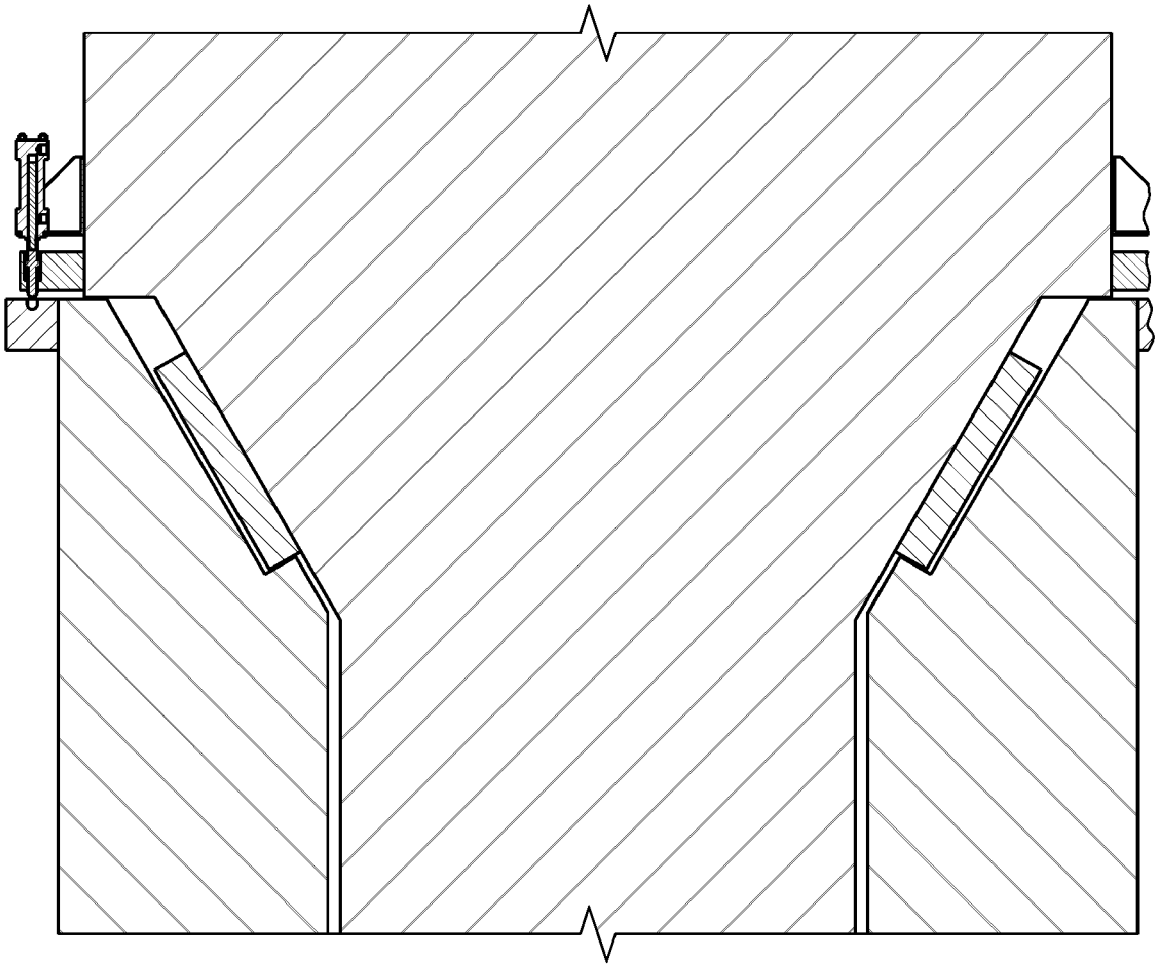
FIGS. 7-10 illustrate docking and rotation mechanisms including bearing and turret lock.
Figure 8:
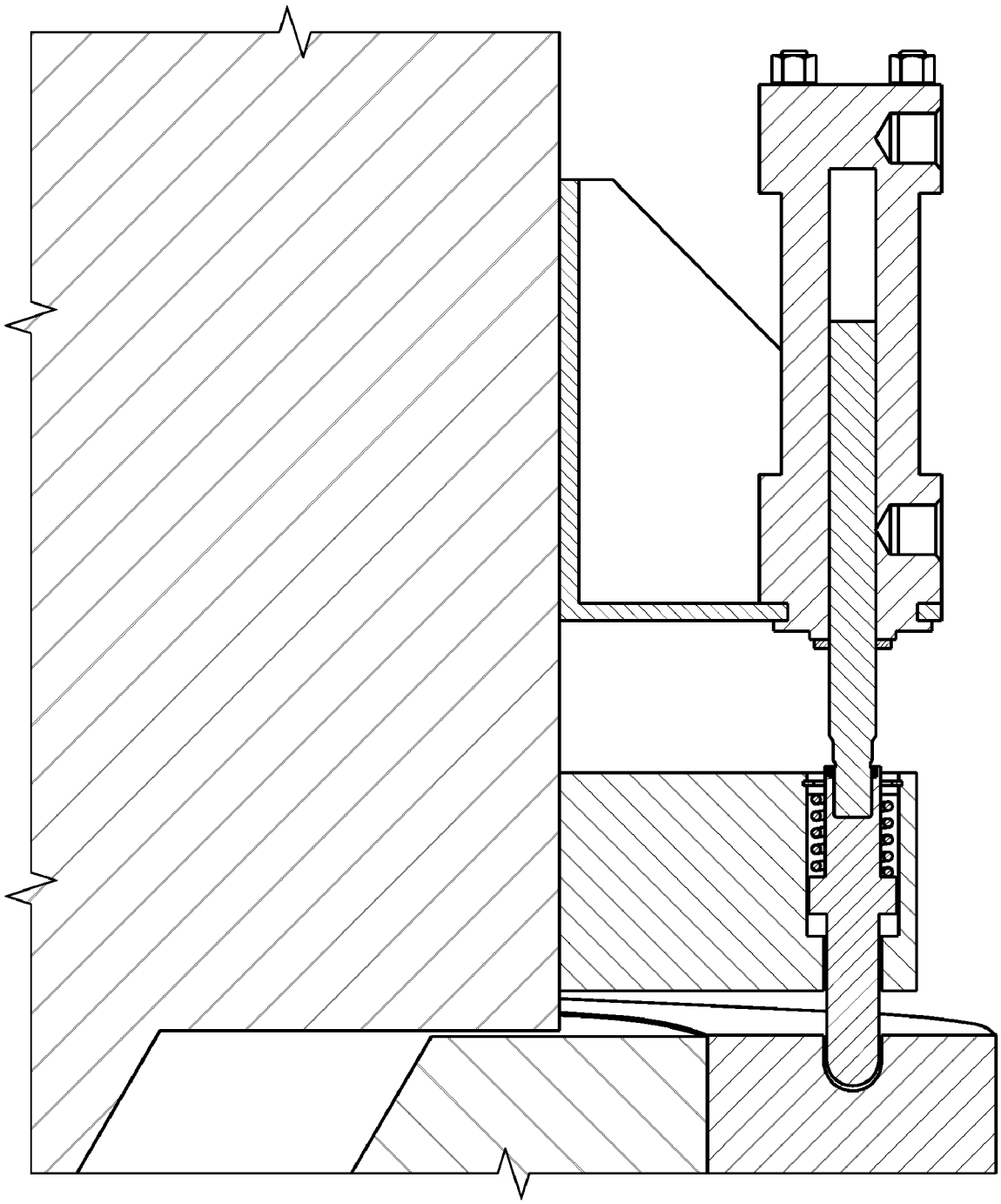
Figure 9:
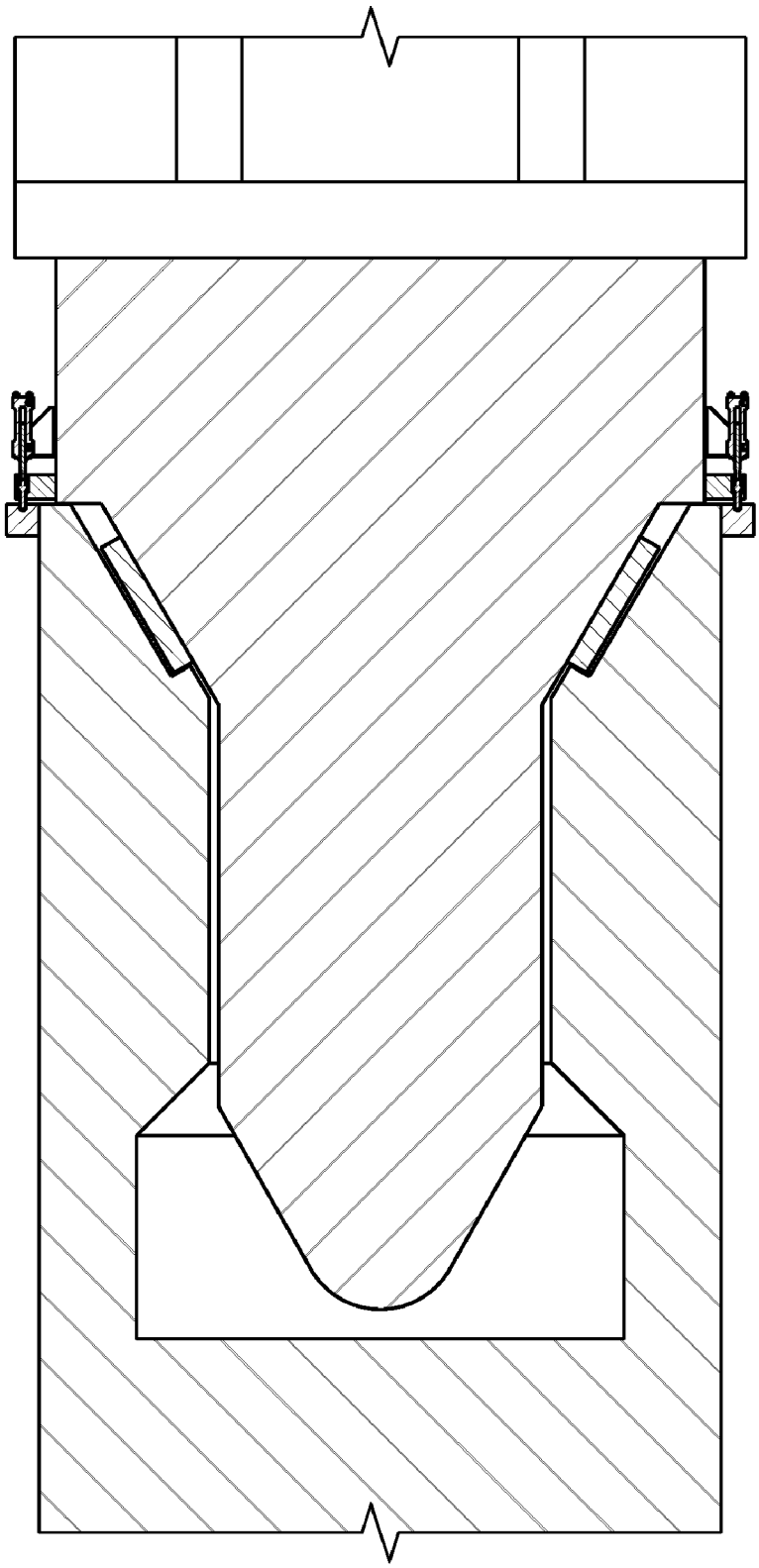
Figure 10:
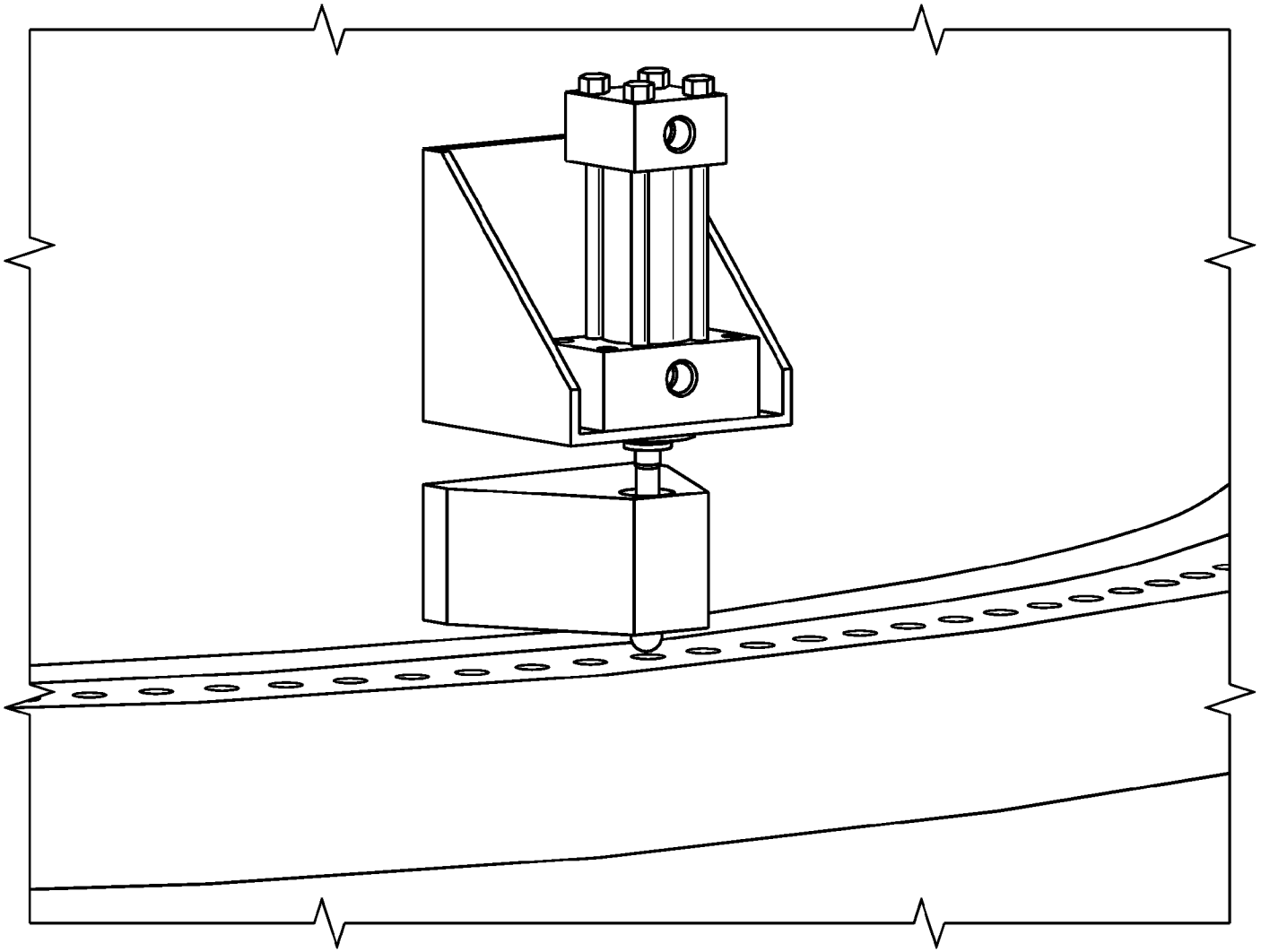

Referring now to FIGS. 1-6, in a first embodiment subsea crane system 1 comprises suction pile 10 and crane 20 rotatably mounted on suction pile 20.

Suction pile 10 is adapted for use subsea and has top surface 11 (FIG. 2) which can accept crane 20.

Crane 20 comprises rotatable mounting surface 30; boom 40 having proximal section 42 attached to rotatable mounting surface 30 such that boom 40 can pivot with respect to mounting surface 30; winch 50 operatively mounted on boom 40; and distal section 44 opposite proximal section 42. Crane 20 is adapted for use subsea and has a weight supportable by suction pile 10 when both are disposed subsea.

Mounting surface 30 is preferably a turret which may allow rotation around vertical axis 12, e.g. an axis along the length of pile 10. In typical environments, crane 20 is fixed into place atop suction pile 10 such as by using pivot 31 which is matable into suction pile 10.

In a preferred embodiment, crane 20 is hydraulically operated and may comprise hydraulic power source 22. Typically, crane 20 houses all required controls to keep the base as simple as possible.

In certain embodiments, remotely operated vehicle (ROV) 100 comprises a hydraulic power supply operatively coupled to crane 20 to provide a source of hydraulic power to crane 20. For example, one or more hydraulic couplings 24 (FIG. 4) may be present and fluidly in communication with hydraulic power supply 22. ROV 100 may use hydraulic couplings 24 to operatively couple to crane 20 to provide a source of hydraulic power to crane 20. In some embodiments, hydraulic couplings 24 operatively couple with complementary couplings 25 (FIG. 4) on ROV 100 which comprises either second hydraulic power supply 102 to provide a source of hydraulic power to hydraulic power supply 22 of crane 20 or to provide the sole source of hydraulic power for crane 20.

Manipulator arm 60 may be mounted on distal section 44 of boom 40 and operatively coupled to a hydraulic power supply 22.

Figure 11A:
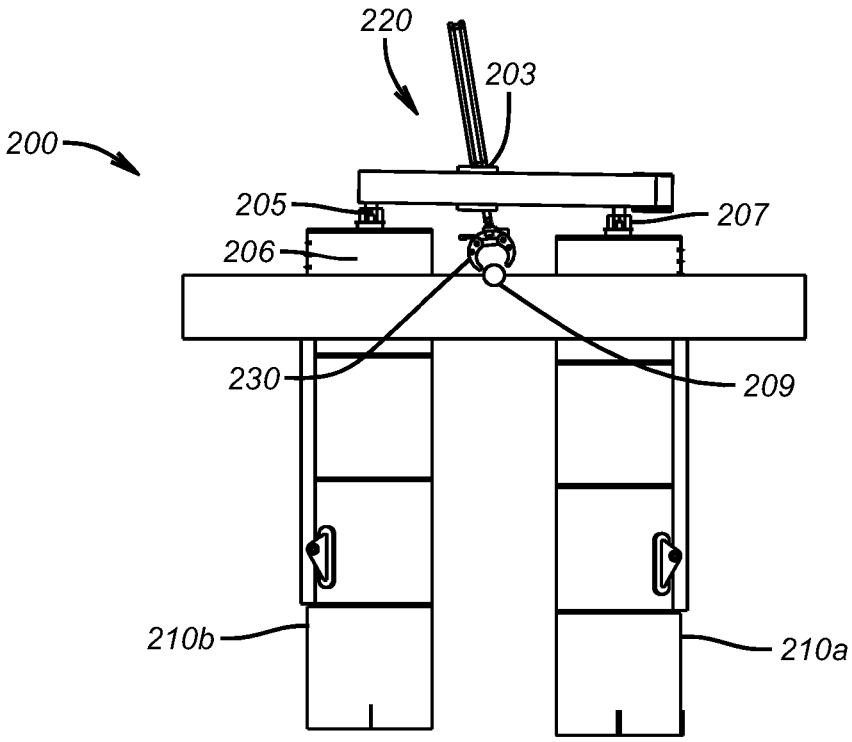
FIGS. 11*a*,11*b*, and 12 illustrate an exemplary dual suction pile system.
Figure 11B:
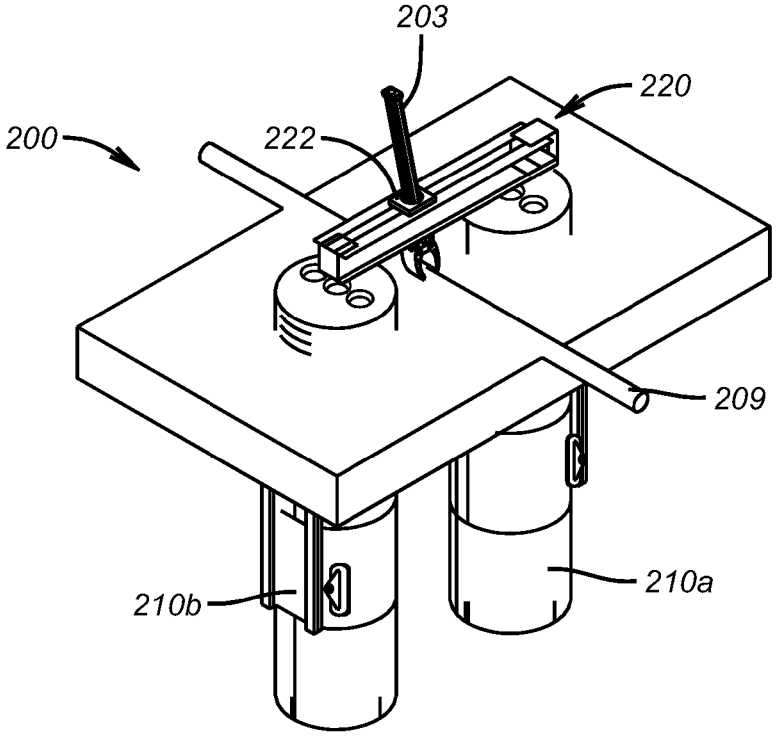
Figure 12:
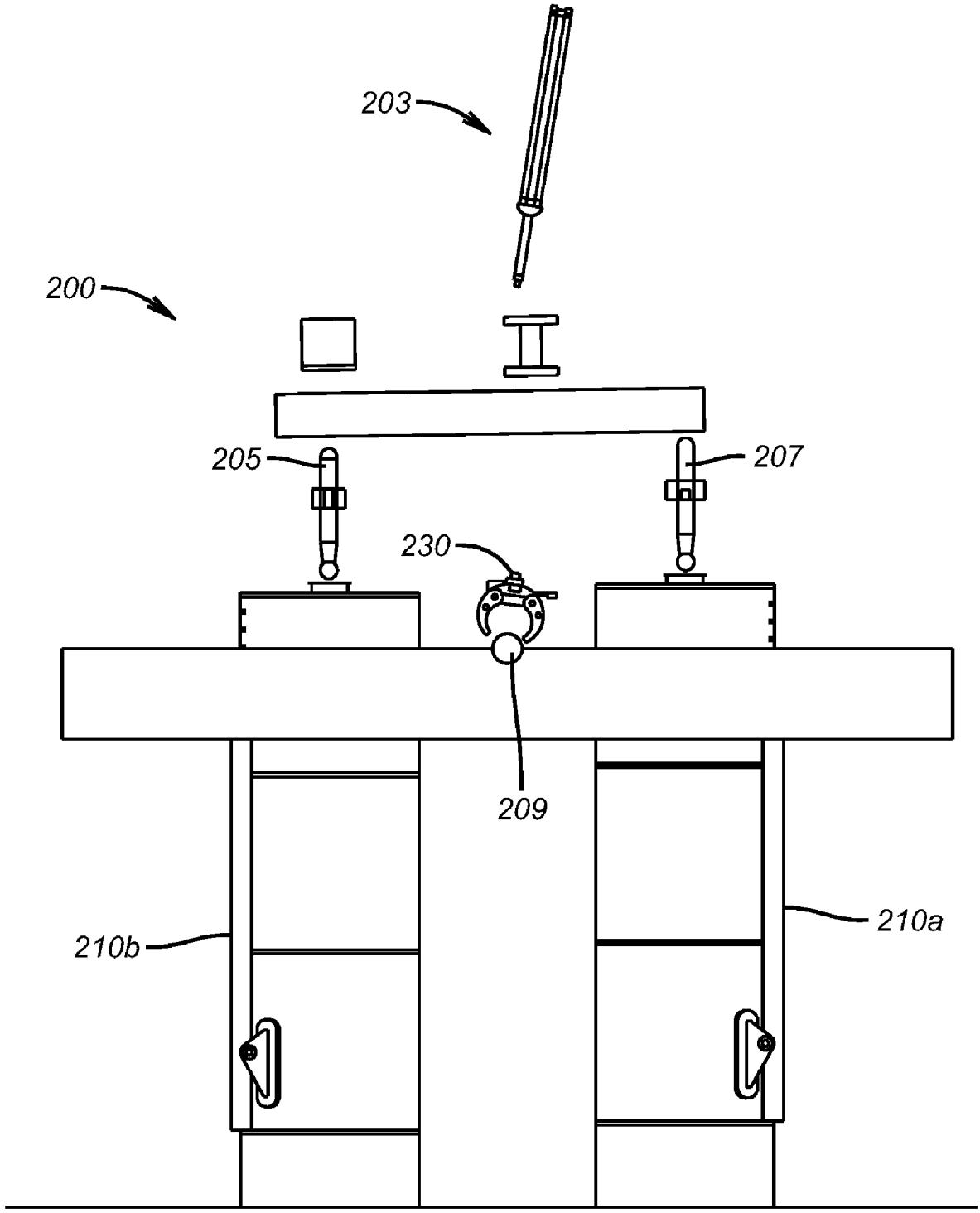
Figure 13A:
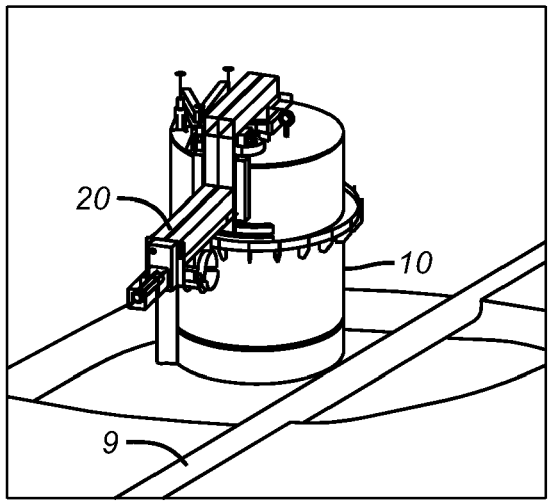
FIGS. 13*a*-13*d* illustrate an exemplary use of a dynamic suction pile embodiment.
Figure 13B:
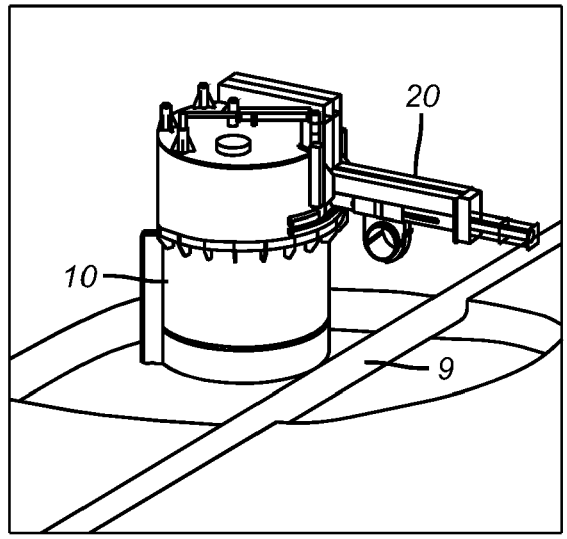
Figure 13C:
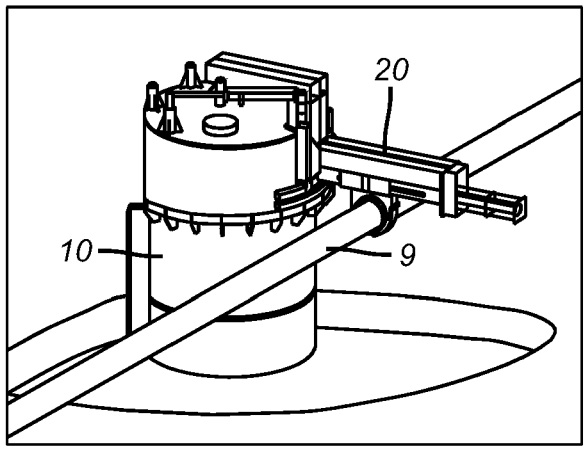
Figure 13D:
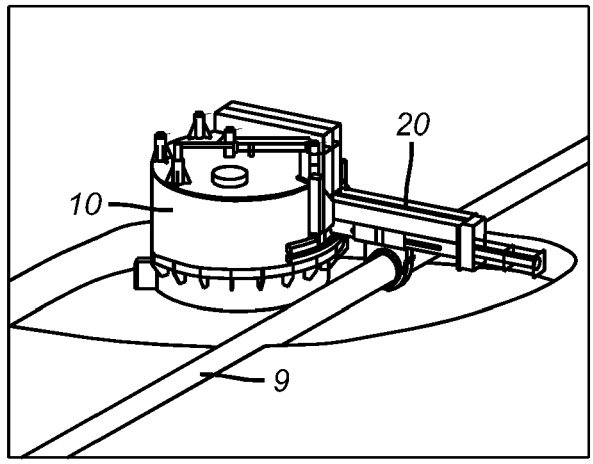

In further embodiments, illustrated in FIGS. 11*a*, 11*b*, and 12, a plurality of piles 210*a*, 210*b* are used. In these configurations, the load that can be carried, e.g. object 209, may be increased and stability provided that cannot be accomplished with a single pile 10 (FIG. 1). System 200 may further provide a supporting structure for a "gantry" type crane, 220. As with the previously described system, piles 210*a*, 210*b* can be static or dynamic.

In a currently preferred embodiment for multiple suction piles, system 200 comprises two piles, 210*a* and 210*b*. Removable installation post 207 may be installed in first pile 210*a*. Rotation mechanism 203 will allow rotation of gantry 220 to accommodate variations in pile height as well as differences in pile verticality. In an embodiment, only one degree-of-freedom is required by this structure. However, the structure may have one or more additional degrees-of-freedom, e.g. via gimbal 205.

In certain embodiments, removable post 205 is installed in second pile 210*b*. Post 205 may receive gimbaled structure 203 which allows rotation in two planes. Post 205 itself may be allowed to rotate.

Traveler 222 (FIG. 11*b*) may be present to allow gimbaled structure 203 to traverse along the length of gantry 220 to allow for variances in the distance between the installed seabed suction piles 210*a*, 210*b* and/or changes in the length of the gantry system 220 necessary to accommodate increased or decreased changes in the distance between attachments point as piles 210*a*, 210*b* are raised and lowered relative to each other.

Fine control of lifting interface 230 is afforded by a lift mechanism such as gimbaled structure 203 which can traverse along the length of gantry 220 and can also raise and lower the lifting interface 230. Lifting interface 230 can include, e.g., tongs, grippers, hooks, and the like, or combinations thereof. Lifting interface 230 may be allowed to hang vertically by virtue of gimbaled structure 203. Additionally, lifting interface 230 can be rotated to align itself with the object to be lifted if necessary.

In the embodiment illustrated in FIGS. 11*a*, 11*b*, and 12, lifting interface 230 is a tong which may be aligned to pipeline 209 to allow pipeline 209 to be lifted. In certain embodiments, lifting mechanism 203 is not required.

In the operation of a preferred embodiment, referring back to FIGS. 1-6, crane 20 may be used subsea by locating suction pile 10 subsea and then positioning crane 20 on top of suction pile 10 subsea. Crane 20 may further be secured on top of suction pile 10 subsea. Typically, gravity will keep crane 20 on the mounting surface of suction pile 10 which will act as a base for crane 20. In most embodiments, a center pole such as pivot 11 (FIG. 2) will stab down into the base of suction pile 10 to address a cantilevered load. In certain embodiments, the positioning, and possibly securing, occurs before suction pile 10 is lowered subsea.

As noted above, crane 20 may be powered hydraulically, either with its own source of hydraulic fluid, by ROV 100 coupled to crane 20 such as with hydraulic couplings 24 (FIG. 4), or a combination of the two. Where ROV 100 is used, either solely or in combination with hydraulic power supply 22, ROV 100 is positioned proximate crane 20 and coupled to crane 20 via hydraulic connector 24. This provides a hydraulic conduit operatively in fluid communication between ROV 100 and a hydraulically operated crane 20. Once coupled, ROV 100 supplies hydraulic fluid to hydraulically operated crane 20 through the hydraulic conduit. This hydraulic fluid comes from a source of hydraulic fluid on ROV 100.

Control of suction piles 10, e.g. in embodiments using dynamic suction piles, may further comprise raising one or more of the suction piles to which crane 20 is mounted. In embodiments of a plurality of suction piles, e.g. FIGS. 11*a*, 11*b*, and 12, piles 210*a* and 210*b* may be raised or lowered independently or simultaneously. This may be accomplished, e.g., by a device that monitors the elevation (relative to seafloor or using water pressure) of both suction piles 210*a*, 210*b* and can control the volume and pressure of water entering or leaving each suction pile 210*a*, 210*b* to control elevation of each suction pile 210*a*, 210*b*. By pumping water out of one or both of suction piles 210*a*, 210*b*, suction piles 210*a*, 210*b* and their associated lifting appurtenances, e.g. crane 220, as well as the load, e.g. 209, can be lowered. Conversely, pumping water into one or both of suction piles 210*a*, 210*b* accomplishes the opposite, a lifting action. Similarly, a single suction pile 10, as illustrated in FIGS. 13*a*-13*d*, may be raised and/or lowered, thereby raising or lowering an object such as pipeline 9. Control of the pumping may be directly or indirectly achieved from ROV 100.

The foregoing disclosure and description of the inventions are illustrative and explanatory. Various changes in the size, shape, and materials, as well as in the details of the illustrative construction and/or a illustrative method may be made without departing from the spirit of the invention.

What is claimed is:

1. A subsea crane, having a weight supportable by a subsea suction pile, comprising:

a. a mounting surface dimensioned and adapted to be attached to a subsea suction pile;

b. an arm, comprising a first end and a second end, the arm attached to the mounting surface at the first end of the arm; and c. a control interface dimensioned and adapted to couple with a remotely operated vehicle (ROV), the control interface comprising a power coupling dimensioned and adapted to receive power from the ROV.

2. The subsea crane of claim 1, wherein the mounting surface is at least one of rotatably attached to the subsea suction pile or rotatably attached to the first end of the arm.

3. The subsea crane of claim 1, wherein the arm is pivotally attached to the mounting surface at the first end of the arm.

4. The subsea crane of claim 1, wherein the arm comprises an extendable boom.

5. The subsea crane of claim 1, wherein the control interface further comprises a non-hydraulic control interface.

6. The crane of claim 1, further comprising a manipulator arm attached to the second end of the arm.

7. The crane of claim 1, wherein:

a. the power coupling is a hydraulic power coupling dimensioned and adapted to receive hydraulic fluid from the ROV; and b. the subsea crane is hydraulically operated.

8. The subsea crane of claim 7, further comprising a hydraulically powered manipulator arm attached to the second end of the arm.

9. A subsea crane system, comprising:

a. a subsea suction pile; and b. a subsea crane, having a weight supportable by the subsea suction pile, comprising:

i. a mounting surface dimensioned and adapted to be attached to a subsea suction pile;

ii. an arm, comprising a first end and a second end, the arm attached to the mounting surface at the first end of the arm; and iii. a control interface dimensioned and adapted to couple with a remotely operated vehicle (ROV), the control interface comprising a power coupling dimensioned and adapted to receive power from the ROV; and c. a winch attached to the boom.

10. The system of claim 9, wherein the crane is hydraulically operated using hydraulic power supplied via the power coupling with hydraulic fluid supplied from the ROV.

11. The system of claim 9, further comprising a manipulator arm mounted proximate the second section of the arm and operatively coupled to the hydraulic fluid coupler.

12. The system of claim 9, wherein the mounting surface comprises a turret.

13. A method of using a crane subsea, comprising:

a. locating a suction pile subsea, the suction pile comprising a top section;

b. attaching a crane to the top section of the suction pile subsea, the crane comprising a control connector;

c. positioning a remotely operated vehicle (ROV) proximate the crane;

d. operatively coupling the control connector to a control interface on the ROV; and e. supplying power to the crane from the ROV via the control interface.

14. The method of claim 13, further comprising pivotally attaching the crane to the top section of the suction pile subsea.

15. The method of claim 14, wherein:

a. the control connector comprises a hydraulic fluid power connector;

b. the crane is hydraulically powered;

c. the control connector is operatively coupled via a hydraulic fluid conduit to the control interface on the ROV; and d. the method further comprises supplying hydraulic fluid to the hydraulically operated crane through the hydraulic fluid conduit from the source of hydraulic fluid on the ROV.

16. The method of claim 13, further comprising supplying the crane with non-hydraulic control via the control connector through the control interface on the ROV.

* * * * *